US009297261B2

(12) United States Patent
Otero

(10) Patent No.: US 9,297,261 B2
(45) Date of Patent: Mar. 29, 2016

(54) AIRFOIL WITH IMPROVED INTERNAL COOLING CHANNEL PEDESTALS

(75) Inventor: Edwin Otero, Southington, CT (US)

(73) Assignee: United Technologies Corporation, Hardford, CT (US)

( * ) Notice: Subject to any disclaimer, the term of this patent is extended or adjusted under 35 U.S.C. 154(b) by 1290 days.

(21) Appl. No.: 13/413,969

(22) Filed: Mar. 7, 2012

(65) Prior Publication Data

US 2013/0232991 A1 Sep. 12, 2013

(51) Int. Cl.
*F01D 5/18* (2006.01)

(52) U.S. Cl.
CPC ..... *F01D 5/187* (2013.01); *F01D 5/188* (2013.01); *F05D 2240/304* (2013.01); *F05D 2250/14* (2013.01); *F05D 2250/231* (2013.01); *F05D 2260/202* (2013.01); *F05D 2260/2214* (2013.01)

(58) Field of Classification Search
CPC .. F05D 2260/22141; F01D 5/18; F01D 5/187
See application file for complete search history.

(56) References Cited

U.S. PATENT DOCUMENTS

| | | | | |
|---|---|---|---|---|
| 4,236,870 | A | 12/1980 | Hucul, Jr. et al. | |
| 5,243,759 | A * | 9/1993 | Brown et al. | 29/889.721 |
| 5,503,529 | A | 4/1996 | Anselmi et al. | |
| 6,234,754 | B1 * | 5/2001 | Zelesky et al. | 416/97 R |
| 6,969,230 | B2 | 11/2005 | Shi et al. | |
| 6,974,308 | B2 | 12/2005 | Halfmann et al. | |
| 7,175,386 | B2 | 2/2007 | Cherolis et al. | |
| 7,311,498 | B2 | 12/2007 | Cunha et al. | |
| 7,837,440 | B2 | 11/2010 | Bunker et al. | |
| 2004/0076519 | A1 | 4/2004 | Halfmann et al. | |
| 2009/0060715 | A1 | 3/2009 | Kopmels | |
| 2009/0175733 | A1 | 7/2009 | Poon et al. | |
| 2010/0221121 | A1 | 9/2010 | Liang | |
| 2010/0226789 | A1 | 9/2010 | Liang | |

FOREIGN PATENT DOCUMENTS

| | | | |
|---|---|---|---|
| EP | 2236752 | A2 | 10/2010 |
| GB | 2244520 | A | 12/1991 |

OTHER PUBLICATIONS

International Search Report and Written Opinion, mailed Jun. 2, 2013.
The European Search Report mailed May 4, 2015 for European Application No. 13757299.6.

* cited by examiner

*Primary Examiner* — Richard Edgar
(74) *Attorney, Agent, or Firm* — Kinney & Lange, P.A.

(57) ABSTRACT

An airfoil for a turbine engine, the airfoil including a first side wall, a second side wall spaced apart from the first side wall, and an internal cooling channel formed between the first side wall and the second side wall. The internal cooling channel includes at least one pedestal having a first pedestal end connected to the first side wall and a second pedestal end connected to the second side wall. The internal cooling channel also includes a first fillet disposed around the periphery of the first pedestal end between the first side wall and the first pedestal end; and a second fillet disposed around the periphery of the second pedestal end between the second side wall and the second pedestal end. At least one of the first fillet and the second fillet includes a profile that is non-uniform around the periphery of the corresponding pedestal end.

19 Claims, 7 Drawing Sheets

AIRFOIL WITH IMPROVED INTERNAL COOLING CHANNEL PEDESTALS

BACKGROUND

The present invention relates to turbine engines. In particular, the invention relates to internal cooling channel pedestals of an airfoil for a turbine engine.

A turbine engine employs a variety of airfoils to extract energy from a flow of combustion gases to perform useful work. Some airfoils, such as, for example, stator vanes and rotor blades, operate downstream of the combustion gases and must survive in a high-temperature environment. Often, airfoils exposed to high temperatures are hollow, having internal cooling channels that direct a flow of cooling air through the airfoil to remove heat and prolong the useful life of the airfoil. A source of cooling air is typically taken from a flow of compressed air produced upstream of the stator vanes and rotor blades. Some of the energy extracted from the flow of combustion gases must be used to provide the compressed air, thus reducing the energy available to do useful work and reducing an overall efficiency of the turbine engine.

Internal cooling channels are designed to provide efficient transfer of heat between the airfoils and the flow of cooling air within. As heat transfer efficiency improves, less cooling air is necessary to adequately cool the airfoils. Internal cooling channels typically include structures to improve heat transfer efficiency including, for example, pedestals (also known as pin fins). Pedestals link opposing sides of such airfoils (pressure side and suction side) to improve heat transfer by increasing both the area for heat transfer and the turbulence of the cooling air flow. The improved heat transfer efficiency results in improved overall turbine engine efficiency.

While the use of hollow airfoils provides for a flow of cooling air to extend the useful life of the airfoils, hollow blades are not as mechanically strong as solid blades. Improvements to the mechanical strength of hollow airfoils are needed to further extend their useful life.

SUMMARY

An embodiment of the present invention is an airfoil for a turbine engine, the airfoil including a first side wall, a second side wall spaced apart from the first side wall, and an internal cooling channel formed between the first side wall and the second side wall. The internal cooling channel includes at least one pedestal having a first pedestal end connected to the first side wall and a second pedestal end connected to the second side wall. The internal cooling channel also includes a first fillet and a second fillet. The first fillet is disposed around the periphery of the first pedestal end between the first side wall and the first pedestal end. The second fillet is disposed around the periphery of the second pedestal end between the second side wall and the second pedestal end. At least one of the first fillet and the second fillet includes a profile that is non-uniform around the periphery of the corresponding pedestal end.

DETAILED DESCRIPTION

The present invention provides for greater mechanical strength and durability of pedestals in an internal cooling channel within an airfoil by employing fillets around the periphery of pedestal ends where the pedestal ends connect to airfoil walls. The fillets each have a profile that is non-uniform around the periphery of the corresponding pedestal end. While larger fillets provide greater mechanical strength, larger fillets also obstruct the flow of cooling air through the internal cooling channel, thereby reducing the heat transfer efficiency gains provided by the pedestals. The non-uniform fillet of the present invention is smaller around most of the periphery of the pedestal end to reduce the obstruction of cooling air flow and larger only at those points likely to experience the highest levels of mechanical stress and serve as initiation points for pedestal connection failure.

Figure 1:
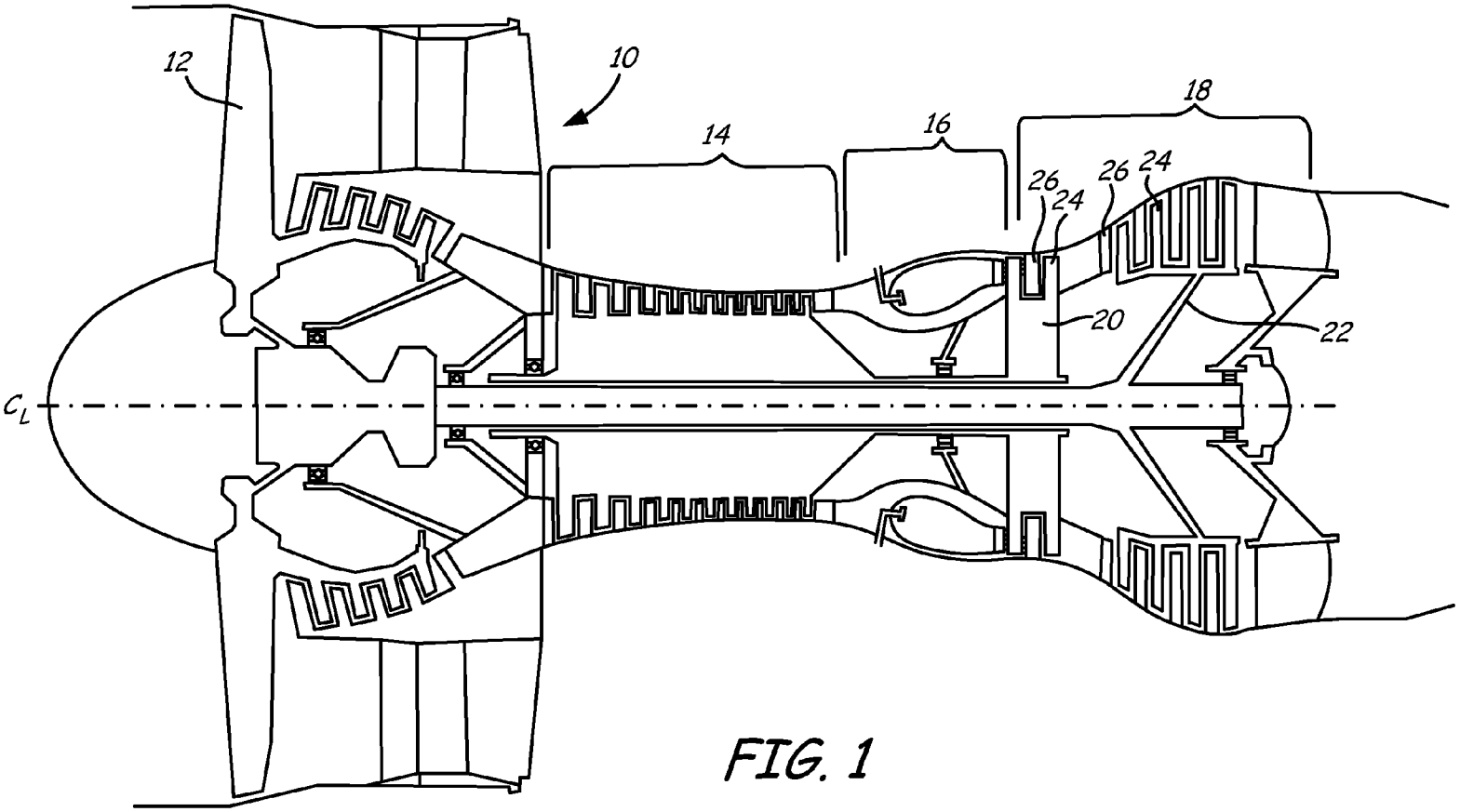
FIG. 1 is a sectional view of gas turbine engine embodying improved internal cooling channel pedestals of the present invention.

FIG. 1 is a representative illustration of a gas turbine engine including airfoils embodying the present invention. The view in FIG. 1 is a longitudinal sectional view along the engine center line. FIG. 1 shows gas turbine engine 10 including fan 12, compressor section 14, combustor section 16, turbine section 18, high-pressure rotor 20, and low-pressure rotor 22. Turbine section 18 includes rotor blades 24 and stator vanes 26. Rotor blades 24 and stator vanes 26 each include airfoil sections, such as airfoil section 134, described below in reference to FIG. 2.

As illustrated in FIG. 1, fan 12 is positioned along engine center line ($C_L$) at one end of gas turbine engine 10. Compressor section 14 is adjacent fan 12 along an engine center line $C_L$, followed by combustor section 16. Turbine section 18 is located adjacent combustor section 16, opposite compressor section 14. High-pressure rotor 20 and low-pressure rotor 22 are mounted for rotation about engine center line $C_L$. High-pressure rotor 20 connects a high-pressure section of turbine section 18 to compressor section 14. Low-pressure rotor 22 connects a low-pressure section of turbine section 18 to fan 12. Rotor blades 24 and stator vanes 26 are arranged throughout turbine section 18 in alternating rows. Rotor blades 24 connect to high-pressure rotor 20 and low-pressure rotor 22.

In operation, air enters compressor section 14 through fan 12. The air is compressed by the rotation of compressor section 14 driven by high-pressure rotor 20. The compressed air from compressor section 14 is divided, with a portion going to combustor section 18, and a portion employed for cooling airfoils, such as rotor blades 24 and stator vanes 26, as described below. Compressed air and fuel are mixed an ignited in combustor section 16 to produce high-temperature, high-pressure combustion gases. The combustion gases exit combustor section 16 into turbine section 18 Stator vanes 26 properly align the flow of the combustion gases for an efficient attack angle on rotor blades 24. Because rotor blades 24 include an airfoil section, the flow of combustion gases past rotor blades 24 drives rotation of both high-pressure rotor 20 and low-pressure rotor 22. High-pressure rotor 20 drives compressor section 14, as noted above, and low-pressure rotor 22 drives fan 16 to produce thrust from gas turbine engine 10. Although embodiments of the present invention are illustrated for a turbofan gas turbine engine for aviation use, it is understood that the present invention applies to other aviation gas turbine engines and to industrial gas turbine engines as well.

Rotor blades 24 spin at relatively high revolutions per minute, resulting in significant mechanical stress on rotor blades 24. In addition, as rotor blades 24 spin past stator vanes 26, they experience a varying flow of combustion gases which causes a change in force experienced by rotor blades 24. A sequence of changing forces experienced by rotor blades 24 as they spin past stator vanes 26 causes a vibratory motion in rotor blades 24 causing warping, or twisting of the airfoil section of rotor blades 24 about each of their respective vertical axes. This warping stress presents a particular challenge to mechanical structures within the airfoil section. As described below, rotor blades 24 embodying the present invention are strengthened to meet this challenge.

Figure 2:
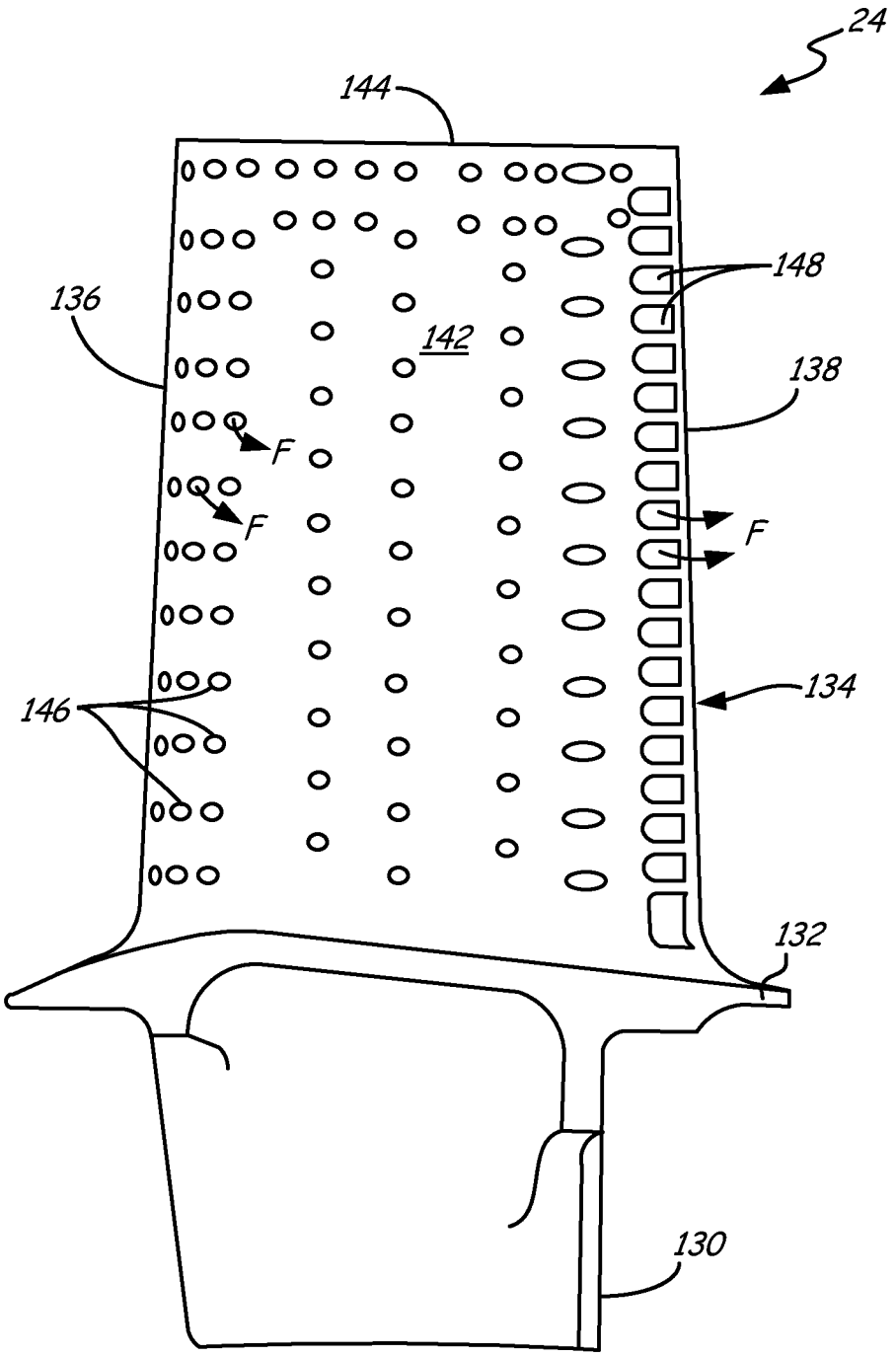
FIG. 2 is a side view of a turbine rotor blade embodying improved internal cooling channel pedestals of the present invention.

As mentioned above, airfoils operating downstream of combustor section 16, such as stator vanes 26 and rotor blades 24, operate in a high-temperature environment. Often, airfoils exposed to high temperatures are hollow, having internal cooling channels that direct a flow of cooling air through the airfoil to remove heat and prolong the useful life of the airfoil. FIG. 2 is a side view of a turbine rotor blade employed in gas turbine engine 10 embodying improved internal cooling channel pedestals of the present invention. FIG. 2 shows rotor blade 24, which includes root section 130, platform 132, and airfoil section 134. Root section 130 provides a physical connection to a rotor, such as high-pressure rotor 20 of FIG. 1. Airfoil section 134 includes leading edge 136, trailing edge 138, suction side wall 140 (shown in FIG. 4), pressure side wall 142, tip 144, and a plurality of surface cooling holes such as film cooling holes 146 and trailing edge cooling slots 148.

Platform 132 connects one end of airfoil section 134 to root section 130. Thus, leading edge 136, trailing edge 138, suction side wall 140, and pressure side wall 142 extend from platform 132. Tip 144 closes off the other end of airfoil section 134. Suction side wall 140 and pressure side wall 142 connect leading edge 136 and trailing edge 138. Film cooling holes 146 are arranged over the surface of airfoil section 134 to provide a layer of cool air proximate the surface of airfoil section 134 to protect it from high-temperature combustion gases. Trailing edge slots 148 are arranged along trailing edge 138 to provide an exit for air circulating within airfoil section 134, as described below in reference to FIG. 3.

Figure 3:
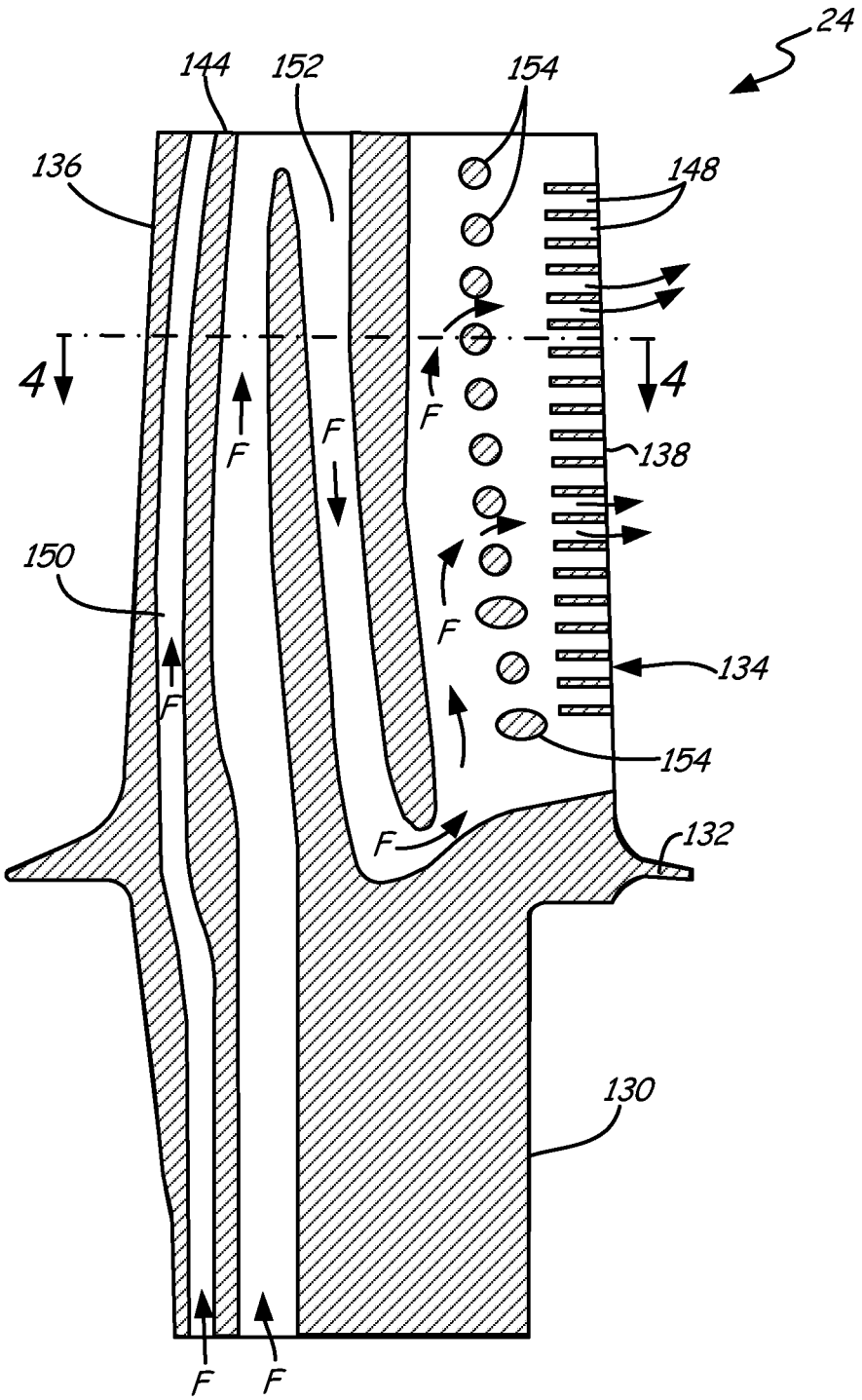
FIG. 3 is a cutaway side view of the turbine rotor blade embodying improved internal cooling channel pedestals of the present invention.

FIG. 3 is a cutaway side view of the turbine rotor blade of FIG. 2. As shown in FIG. 3, rotor blade 24 includes two internal cooling channels, leading edge channel 150, and serpentine cooling channel 152. Serpentine cooling channel 152 includes pedestals 154. Leading edge channel 150 and serpentine cooling channel 152 extend from root section 130, through platform 132, into airfoil section 134. Film cooling holes 146 near leading edge 136 are in fluid communication with leading edge channel 150. The balance of film cooling holes 146 and trailing edge slots 148 are in fluid communication with serpentine cooling channel 152.

Considering FIGS. 2 and 3 together, rotor blade 24 is cooled by flow of cooling air F entering leading edge channel 150 and serpentine cooling channel 152 at root 130. Flow of cooling air F entering leading edge channel 150 internally cools a portion of rotor blade 24 near leading edge 136 before flowing out through film cooling holes near leading edge 136. Flow of cooling air F entering serpentine cooling channel 152 internally cools a remaining portion of rotor blade 24 before flowing out through the balance of film cooling holes 146 and trailing edge slots 148. As serpentine cooling channel 152 nears trailing edge 134, flow of cooling air F impinges on the plurality of pedestals 154. Pedestals 154 provide increased surface area for heat transfer from rotor blade 24 to flow of cooling air F, compared to portions of serpentine cooling channel 152 that do not contain pedestals 154. In addition, pedestals 154 create turbulence in flow of cooling air F to increase convective heat transfer. Pedestals 154 also help stabilize the physical structure of rotor blade 24. As shown in the side view of FIG. 3, pedestals 154 may have different cross-sectional shapes, for example, circular and elliptical.

Figure 4:
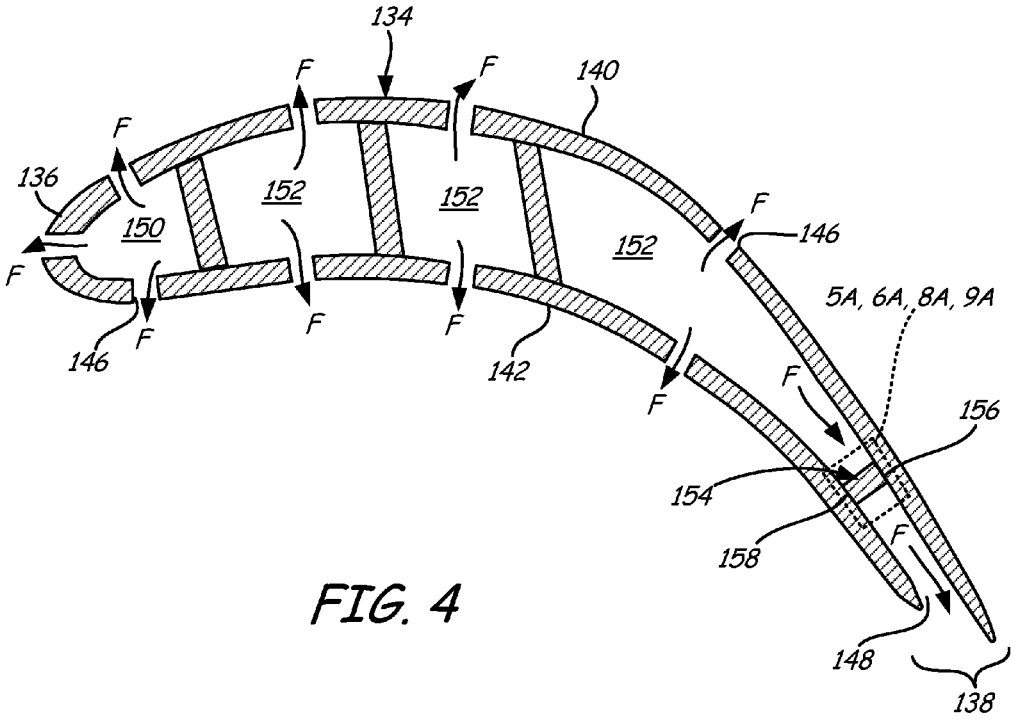
FIG. 4 is an enlarged cross-sectional view of a portion of the turbine rotor blade of FIG. 3 embodying improved internal cooling channel pedestals of the present invention.

FIG. 4 is an enlarged cross-sectional view of airfoil section 134 of rotor blade 24 of FIG. 3. FIG. 4 shows leading edge 136 and trailing edge 138 connected by suction side wall 140 and pressure side wall 142. Pressure side wall 142 is spaced apart from suction side wall 140. Leading edge channel 150 and serpentine cooling channel 152 are formed between suction side wall 140 and pressure side wall 142. Film cooling holes 146 are in fluid communication with leading edge channel 150 and serpentine cooling channel 152. FIG. 4 shows that pedestal 154 within serpentine cooling channel 142 is connected on first end 156 to pedestal side wall 140 and connected on second end 158 to pressure side wall 142, thus extending across serpentine cooling channel 152.

In operation, rotor blade 24 is exposed not only to high-temperature combustion gases, but to extreme mechanical stresses, including the warping stress experienced by airfoil section 134 described above. Warping stress experienced by airfoil section 134 creates a mechanical stress at locations where pedestal 154 connects to suction side wall 140 and where pedestal 154 connects to pressure side wall 142. Such mechanical stresses can result in mechanical failure of one of the pedestal connections. The present invention employs fillets around the periphery of pedestal 154, between first end 156 and suction side wall 140 and between second end 158 and pressure side wall 142. Fillets spread the stress at the pedestal connections over a larger area, reducing the level of stress at any particular location to prevent mechanical failure. Larger fillets spread the stress over a larger area, protecting against a higher level of warping stress. However, larger fillets obstruct serpentine flow channel 152, and the flow of cooling air, thereby reducing the heat transfer efficiency gains provided by pedestals 154. Thus, determining the proper fillet size involves a trade off between mechanical durability and heat transfer efficiency. The present invention overcomes this problem with a fillet that is smaller around most of the periphery of the pedestal end and larger only at those points likely to experience the highest levels of mechanical stress and serve as initiation points for pedestal connection failure.

Figure 5A:
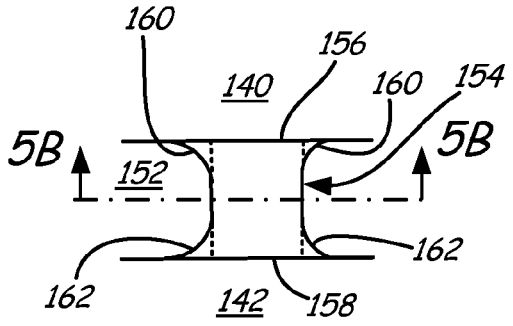
FIGS. 5A and 5B are top cross-sectional and side cross-sectional views of a cooling channel pedestal embodying the present invention.
Figure 5B:
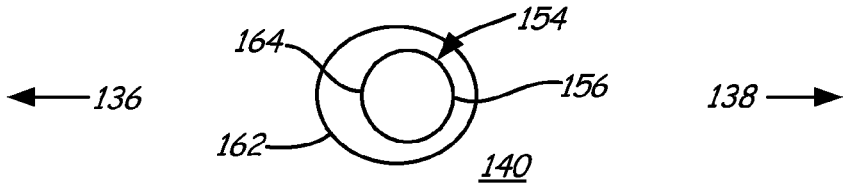

FIGS. 5A and 5B are top cross-sectional and side cross-sectional views of a cooling channel pedestal embodying the present invention. FIG. 5A shows an enlarged view of serpentine cooling channel 152 between suction side wall 140 and pressure side wall 142, including pedestal 154. Serpentine cooling channel 152 further includes first fillet 160 disposed around the periphery of first end 156 and second fillet 162 disposed around the periphery of second end 158. The top cross-sectional view of FIG. 5A shows a profile of first fillet 160 in a direction perpendicular to the corresponding side wall, suction side wall 140, at two points around the periphery of first end 156. As shown in FIG. 5A, the profile of first fillet 160 is not uniform, having a larger fillet profile on one side of first end 156 and a smaller fillet profile on the other side. FIG. 5A shows a similar arrangement for second end 158, with second fillet 162 having a profile that is non-uniform around the periphery of second end 158.

In this embodiment, first fillet 160 and second fillet 162 are concave and their respective profiles at any point around the periphery of the corresponding pedestal end may be described by a simple curve, that is, described by a single radius of curvature at that point. However, it is understood that other profiles are encompassed by the present invention, including compound curves, as described below in reference to FIGS. 9A and 9B, and elliptical curves.

The side cross-sectional view of FIG. 5B further illustrates that first fillet 160 is non-uniform around the periphery of first end 156. As shown in FIG. 5B, first fillet 160 includes first point 164. First point 164 includes a first local maximum value of the radius of curvature, that is, the radius of curvature at first point 164 is greater than radii of curvature for points around the periphery of first end 156 adjacent first point 164 and on opposite sides of first point 164. In the embodiment shown in FIG. 5B, first point 164 is also a point around the periphery of first end 156 nearest leading edge 136. Placing first point 164 at this location serves to strengthen the initiation point for connection failure due to mechanical stress in this particular embodiment.

Figure 6A:
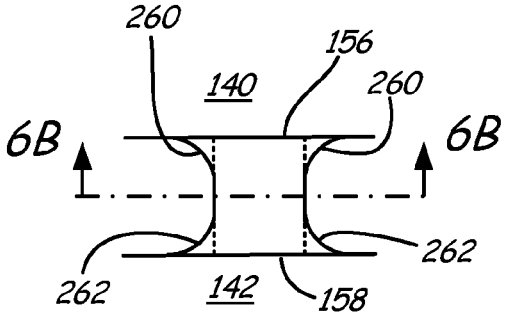
FIGS. 6A and 6B are top cross-sectional and side cross-sectional views of another cooling channel pedestal embodying the present invention.
Figure 6B:
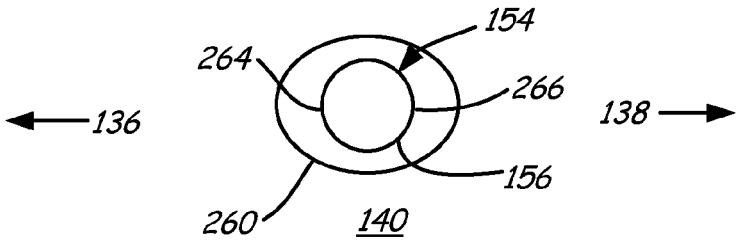

FIGS. 6A and 6B are top cross-sectional and side cross-sectional views of another cooling channel pedestal embodying the present invention. The embodiment shown in FIGS. 6A and 6B is identical to that of FIGS. 5A and 5B except for the fillets. Serpentine cooling channel 152 further includes first fillet 260 disposed around the periphery of first end 156 and second fillet 262 disposed around the periphery of second end 158. Considering FIGS. 6A and 6B together, the profile of first fillet 260 is not uniform, having a larger fillet profile on opposite sides of pedestal end 156 and a smaller fillet profile between the two larger profiles. As shown in FIG. 6B, first fillet 260 includes first point 264 and second point 266. First point 264 includes a first local maximum value of the radius of curvature and second point 266 includes a second local maximum value of the radius of curvature. Thus, the radius of curvature at first point 264 is greater than radii of curvature for points around the periphery of first end 156 adjacent first point 264 and on opposite sides of first point 264; and the radius of curvature at second point 266 is greater than radii of curvature for points around the periphery of second end 158 adjacent second point 266 and on opposite sides of second point 266. In the embodiment shown in FIG. 6B, first point 264 is also a point around the periphery of first end 156 nearest leading edge 136 and second point 266 is also a point around the periphery of first end 156 nearest trailing edge 138. Placing first point 264 at the leading edge 136 and second point 266 at trailing edge serves to strengthen two initiation points for connection failure due to mechanical stress in this particular embodiment.

Figure 7:
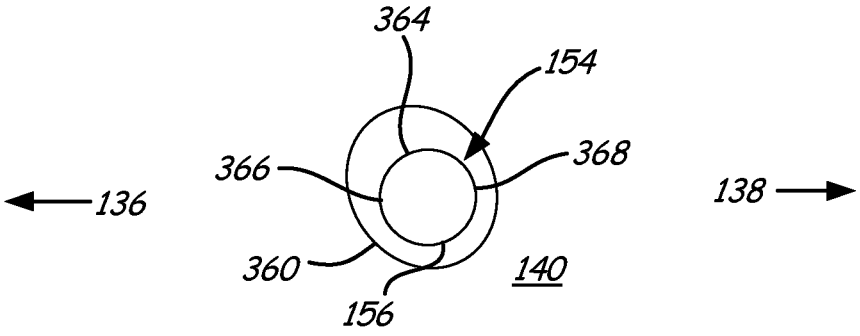
FIG. 7 is a side cross-sectional view of another cooling channel pedestal embodying the present invention.

FIG. 7 is a side cross-sectional view of another cooling channel pedestal embodying the present invention. The embodiment shown in FIG. 7 is identical to that of FIGS. 5A and 5B except for the fillets. The embodiment of FIG. 7 includes first fillet 360 disposed around the periphery of first end 156. First fillet 360 includes first point 364, second point 366, and third point 368. First point 364 includes a first local maximum value of the radius of curvature. Second point 366 is a point around the periphery of first end 156 nearest leading edge 136. Third point 368 is a point around the periphery of first end 156 nearest trailing edge 138. In the embodiment shown in FIG. 7, first point 364 is also a point around the periphery of first end 156 between second point 366 and third point 368. Placing first point 364 at a point around the periphery of first end 156 between second point 366 and third point 368 serves to strengthen the initiation point for connection failure due to mechanical stress in this particular embodiment.

Figure 8A:
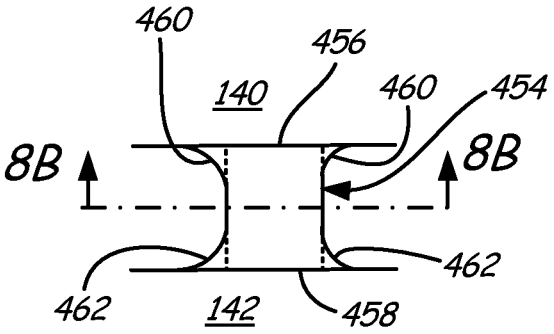
FIGS. 8A and 8B are top cross-sectional and side cross-sectional views of another cooling channel pedestal embodying the present invention.
Figure 8B:
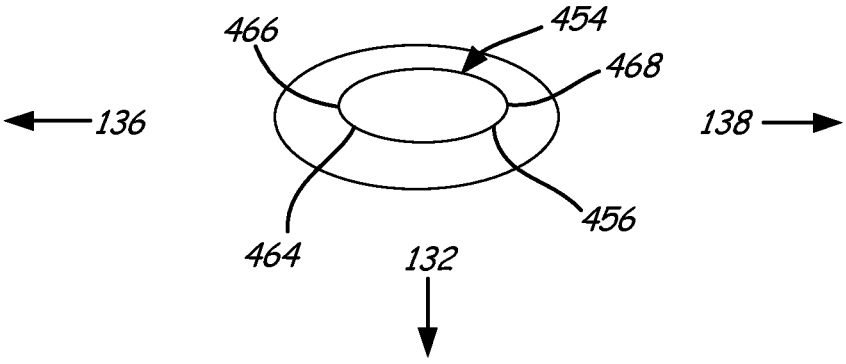

FIGS. 8A and 8B are top cross-sectional and side cross-sectional views of another cooling channel pedestal embodying the present invention. The embodiment shown in FIGS. 8A and 8B is identical to that of FIGS. 5A and 5B except for the fillets and for the shape of the pedestal. Pedestal 454 is identical to pedestal 154 in previous embodiments, except that pedestal 454 has an elliptical cross section instead of a circular cross section. Pedestal 454 includes first end 456 and second end 458. Serpentine cooling channel 152 further includes first fillet 460 disposed around the periphery of first end 456 and second fillet 462 disposed around the periphery of second end 458. As shown in FIG. 8A, the profiles of first fillet 460 and second fillet 462 each have a profile that is non-uniform around the periphery of their corresponding pedestal end 456, 458.

As shown in FIG. 8B, first fillet 460 includes first point 464, second point 466, and third point 468. First point 464 includes a first local maximum value of the radius of curvature. Second point 466 is a point around the periphery of first end 456 nearest leading edge 136. Third point 468 is a point around the periphery of first end 456 nearest trailing edge 138. In the embodiment shown in FIGS. 8A and 8B, first point 464 is also a point around the periphery of first end 456 between second point 466 and third point 468 and closer to second point 466 than to third point 468. In addition, first point 464 is closer to platform 132 than either second point 466 or third point 468. Placing first point 464 at a point around the periphery of first end 456 closer to second point 466 and than third point 468, but closer to platform 132 than either second point 466 or third point 468 serves to strengthen the initiation point for connection failure due to mechanical stress in this particular embodiment.

Figure 9A:
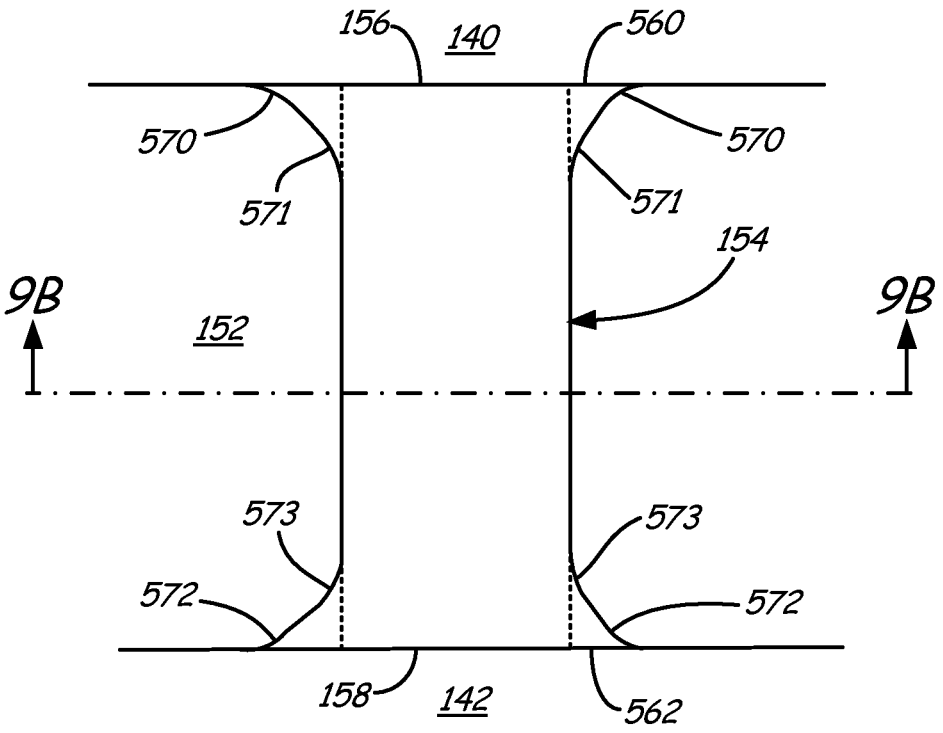
FIGS. 9A and 9B are top cross-sectional and side cross-sectional views of another cooling channel pedestal embodying the present invention.
Figure 9B:
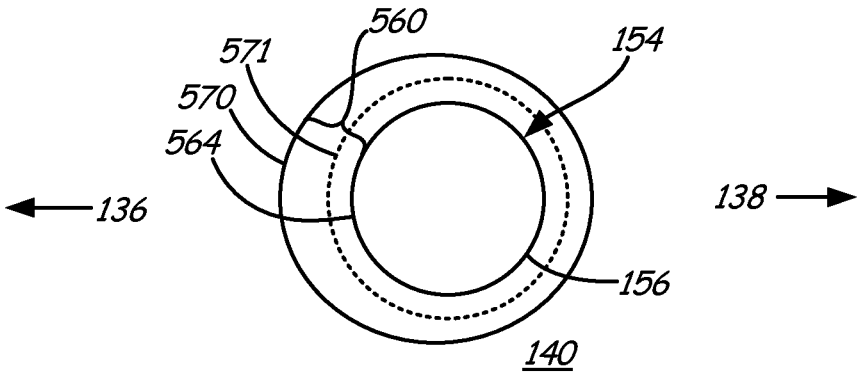

FIGS. 9A and 9B are top cross-sectional and side cross-sectional views of another cooling channel pedestal embodying the present invention. The embodiment shown in FIGS. 9A and 9B is identical to that of FIGS. 5A and 5B except for the fillets. Serpentine cooling channel 152 further includes first fillet 560 disposed around the periphery of first end 156 and second fillet 562 disposed around the periphery of second end 158. Considering FIGS. 9A and 9B together, the profile of first fillet 560 is not uniform around the periphery of first end 156. First fillet 560 and second fillet 562 are concave, but their respective profiles at any point around the periphery of the corresponding pedestal end are described by a compound curve, that is, a curve described by two simple curves having two radii of curvature with different center points. The radii of curvature may have the same value, but must have different center points. Thus, for example, a profile of first fillet 560 at any point around the periphery of first end 156 is described by a first radius of curvature describing first portion 570 of the profile of first fillet 560 at that point, and a second radius of curvature describing second portion 571 of the profile of first fillet 560 at that point, first portion 570 being closer to suction side wall 140 than second portion 571.

The side cross-sectional view of FIG. 9B further illustrates that first fillet 560 is non-uniform around the periphery of first end 156. As shown in FIG. 9B, first fillet 560 includes first point 564. First point 564 includes a first local maximum value of the first radius of curvature. In the embodiment shown in FIG. 9B, first point 564 is also a point around the periphery of first end 156 nearest leading edge 136. Placing first point 564 at this location serves to strengthen the initiation point for connection failure due to mechanical stress in this particular embodiment.

In embodiments described above, first fillets and second fillets are illustrated as mirror images on either end of the pedestal, such as first fillet 160 and second fillet 162 on either end of pedestal 154 as described above in reference to FIGS. 5A and 5B. However, it is understood that the present invention encompasses embodiments in which only one of the first fillet or second fillet includes a profile that is non-uniform around the periphery of the corresponding pedestal end. In addition, the present invention encompasses embodiments in which first fillets and second fillets both include a profile that is non-uniform around the periphery of the corresponding pedestal end, but are not mirror images on either end of the pedestal, for example, an embodiment including first fillet 160 and second fillet 262 on either end of pedestal 154.

The present invention has been described in detail with respect to rotor blades. However, it is understood that the present invention encompasses embodiments in which the airfoil section is a stator vane, such as stator vane 26. Although stator vanes are not subject to stresses as severe as rotor blades, stator vanes are nonetheless subject to warping stresses due to reaction forces from their proximity to spinning rotor blades.

For simplicity in illustration and to avoid unnecessary repetition, many of the embodiments are described above with a larger portion of a non-uniform fillet nearer a leading edge of an airfoil. However, it is understood that the present invention also encompasses embodiments where a larger portion of a non-uniform fillet is nearer a trailing edge of an airfoil. Similarly, use of a serpentine cooling channel leading to a trailing edge of an airfoil, with a pedestal array near the trailing edge is merely exemplary. It is understood that the present invention encompasses embodiments where the internal cooling channel is of other shapes and varieties, including, for example, multi-walled internal cooling channels where the side walls to which pedestal ends attach are not a pressure side wall or a suction side wall. The present invention also encompasses embodiments where pedestals are not near the trailing edge of an airfoil.

A method for providing enhanced gas turbine engine airfoil durability begins with introducing cooling air into an internal cooling channel within the airfoil. The cooling air flows through the internal cooling channel past pedestals connected to walls of the airfoil. The internal cooling channel includes fillets at pedestal ends, at least some of the fillets including a profile that is non-uniform around the periphery of the corresponding pedestal end. Finally, cooling air is exhausted through the trailing edge cooling slot.

The present invention provides for greater mechanical strength and durability of pedestals in an internal cooling channel within an airfoil by employing fillets around the periphery of pedestal ends where the pedestal ends connect to airfoil walls. The fillets each have a profile that is non-uniform around the periphery of the corresponding pedestal end. The non-uniform fillet of the present invention is smaller around most of the periphery of the pedestal end to reduce the obstruction of cooling air flow and larger only at those points likely to experience the highest levels of mechanical stress and serve as initiation points for pedestal connection failure.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

Discussion of Possible Embodiments

The following are non-exclusive descriptions of possible embodiments of the present invention.

An airfoil for a turbine engine can include a first side wall; a second side wall spaced apart from the first side wall; and an internal cooling channel formed between the first side wall and the second side wall, the internal cooling channel including at least one pedestal having a first pedestal end connected to the first side wall and a second pedestal end connected to the second side wall; a first fillet disposed around the periphery of the first pedestal end between the first side wall and the first pedestal end; and a second fillet disposed around the periphery of the second pedestal end between the second side wall and the second pedestal end; wherein at least one of the first fillet and the second fillet includes a profile that is non-uniform around the periphery of the corresponding pedestal end.

The airfoil of the preceding paragraph can optionally include, additionally and/or alternatively, any one or more of the following features, configurations and/or additional components:

the airfoil is one of a turbine rotor blade and a turbine stator vane;

the pedestal is one of a cylinder and an elliptic cylinder;

the airfoil further includes a leading edge; a trailing edge; a pressure side wall connecting the leading edge and the trailing edge; and a suction side wall spaced apart from the pressure side wall, the suction side wall connecting the leading edge and the trailing edge; wherein the pressure side wall is the first side wall and the suction side wall is the second side wall;

the profile is a simple curve described at any point around the periphery of the corresponding pedestal end by a radius of curvature at a point; the profile at a first point includes a first local maximum value of the radius of curvature; the first point being a point around the periphery nearest the leading edge;

the profile at a second point includes a second local maximum value of the radius of curvature, the second point being a point around the periphery nearest the trailing edge;

the profile is a compound curve described at any point by a first radius of curvature describing a first portion of the profile at that point and a second radius of curvature describing a second portion of the profile at that point, each radius having a different center point; the first portion being closer to the corresponding one of the pressure side wall and the suction side wall than the second portion; the profile at a first point includes a first local maximum value of the first radius of curvature; the first point being a point around the periphery nearest the leading edge;

the profile is a simple curve described at any point by a radius of curvature at that point; the profile at a first point includes a first local maximum value of the radius of curvature; the first point between a second point around the periphery nearest the leading edge, and a third point around the periphery nearest the trailing edge;

the first point is closer to the second point than to the third point;

the airfoil further includes a platform from which the leading edge, trailing edge, pressure side wall, and suction side wall extend; wherein the first point is closer to the platform than either of the second point or the third point; and/or the airfoil further includes a platform from which the leading edge, trailing edge, pressure side wall, and suction side wall extend; wherein the first point is farther from the platform than either of the second point or the third point.

A gas turbine engine can include a compressor section; a combustor section; and a turbine; the turbine including a plurality of airfoils, at least one of the plurality of airfoils including a first side wall; a second side wall spaced apart from the first side wall; and an internal cooling channel formed between the first side wall and the second side wall, the internal cooling channel including at least one pedestal having a first pedestal end connected to the first side wall and a second pedestal end connected to the second side wall; a first fillet disposed around the periphery of the first pedestal end between the first side wall and the first pedestal end; and a second fillet disposed around the periphery of the second pedestal end between the second side wall and the second pedestal end; wherein at least one of the first fillet and the second fillet includes a profile that is non-uniform around the periphery of the corresponding pedestal end.

The engine of the preceding paragraph can optionally include, additionally and/or alternatively, any one or more of the following features, configurations and/or additional components:

wherein the at least one of the plurality of airfoils is one of a rotor blade and a stator vane;

wherein the pedestal is one of a cylinder and an elliptic cylinder;

the least one of the plurality of airfoils further includes a leading edge; a trailing edge; a pressure side wall connecting the leading edge and the trailing edge; and a suction side wall spaced apart from the pressure side wall, the suction side wall connecting the leading edge and the trailing edge; wherein the pressure side wall is the first side wall and the suction side wall is the second side wall;

the profile is a simple curve described at any point around the periphery of the corresponding pedestal end by a radius of curvature at that point; the profile at a first point includes a first local maximum value of the radius of curvature; the first point being a point around the periphery nearest the leading edge;

the profile at a second point includes a second local maximum value of the radius of curvature, the second point being a point around the periphery nearest the trailing edge;

the profile is a compound curve described at any point by a first radius of curvature describing a first portion of the profile at that point and a second radius of curvature describing a second portion of the profile at that point, each radius having a different center point; the first portion being closer to the corresponding one of the pressure side wall and the suction side wall than the second portion; the profile at a first point includes a first local maximum value of the first radius of curvature; the first point being a point around the periphery nearest the leading edge;

the profile is a simple curve described at any point by a radius of curvature at that point; the profile at a first point includes a first local maximum value of the radius of curvature; the first point between a second point around the periphery nearest the leading edge, and a third point around the periphery nearest the trailing edge;

the first point is closer to the second point than to the third point;

the engine further includes a platform from which the leading edge, trailing edge, pressure side wall, and suction side wall extend; wherein the first point is closer to the platform than either of the second point or the third point; and/or the engine further includes a platform from which the leading edge, trailing edge, pressure side wall, and suction side wall extend; wherein the first point is farther from the platform than either of the second point or the third point.

A method for providing enhanced gas turbine engine airfoil durability, the method includes introducing cooling air into an internal cooling channel within the airfoil; flowing the cooling air through the internal cooling channel past pedestals connected to walls of the airfoil; the internal cooling channel including fillets at pedestal ends, at least some of the fillets including a profile that is non-uniform around the periphery of the corresponding pedestal end; and exhausting cooling air through trailing edge cooling slots.

The invention claimed is:

1. An airfoil for a turbine engine, the airfoil comprising:

a first side wall;

a second side wall spaced apart from the first side wall;

an internal cooling channel formed between the first side wall and the second side wall, the internal cooling channel comprising:

at least one pedestal having a first pedestal end connected to the first side wall and a second pedestal end connected to the second side wall;

a first fillet disposed around the periphery of the first pedestal end between the first side wall and the first pedestal end; and a second fillet disposed around the periphery of the second pedestal end between the second side wall and the second pedestal end;

wherein at least one of the first fillet and the second fillet includes a profile that is non-uniform around the periphery of the corresponding pedestal end, further wherein the profile is a simple curve described at any point around the periphery of the corresponding pedestal end by a radius of curvature at a point; the profile at a first point includes a first local maximum value of the radius of curvature; the first point being a point around the periphery nearest a leading edge of the airfoil;

a trailing edge;

a pressure side wall connecting the leading edge and the trailing edge; and a suction side wall spaced apart from the pressure side wall, the suction side wall connecting the leading edge and the trailing edge; wherein the pressure side wall is the first side wall and the suction side wall is the second side wall.

2. The airfoil of claim 1, wherein the airfoil is one of a turbine rotor blade and a turbine stator vane.

3. The airfoil of claim 1, wherein the pedestal is one of a cylinder and an elliptic cylinder.

4. The airfoil of claim 1, wherein the profile at a second point includes a second local maximum value of the radius of curvature, the second point being a point around the periphery nearest the trailing edge.

5. The airfoil of claim 1, wherein the profile is a compound curve described at any point by a first radius of curvature describing a first portion of the profile at that point and a second radius of curvature describing a second portion of the profile at that point, each radius having a different center point; the first portion being closer to the corresponding one of the pressure side wall and the suction side wall than the second portion; the profile at a first point includes a first local maximum value of the first radius of curvature; the first point being a point around the periphery nearest the leading edge.

6. The airfoil of claim 1, wherein the profile is a simple curve described at any point by a radius of curvature at that point; the profile at a first point includes a first local maximum value of the radius of curvature; the first point between a second point around the periphery nearest the leading edge, and a third point around the periphery nearest the trailing edge.

7. The airfoil of claim 6, wherein the first point is closer to the second point than to the third point.

8. The airfoil of claim 7, further comprising:

a platform from which the leading edge, trailing edge, pressure side wall, and suction side wall extend;

wherein the first point is closer to the platform than either of the second point or the third point.

9. The airfoil of claim 7, further comprising:

a platform from which the leading edge, trailing edge, pressure side wall, and suction side wall extend;

wherein the first point is farther from the platform than either of the second point or the third point.

10. A gas turbine engine comprising:

a compressor section;

a combustor section; and a turbine including:

a plurality of airfoils, at least one of the plurality of airfoils including:

a first side wall;

a second side wall spaced apart from the first side wall;

an internal cooling channel formed between the first side wall and the second side wall, the internal cooling channel comprising:

at least one pedestal having a first pedestal end connected to the first side wall and a second pedestal end connected to the second side wall;

a first fillet disposed around the periphery of the first pedestal end between the first side wall and the first pedestal end; and a second fillet disposed around the periphery of the second pedestal end between the second side wall and the second pedestal end;

wherein at least one of the first fillet and the second fillet includes a profile that is non-uniform around the periphery of the corresponding pedestal end, further wherein the profile is a simple curve described at any point around the periphery of the corresponding pedestal end by a radius of curvature at a point; the profile at a first point includes a first local maximum value of the radius of curvature; the first point being a point around the periphery nearest a leading edge of the airfoil;

a trailing edge;

a pressure side wall connecting the leading edge and the trailing edge; and a suction side wall spaced apart from the pressure side wall, the suction side wall connecting the leading edge and the trailing edge; wherein the pressure side wall is the first side wall and the suction side wall is the second side wall.

11. The engine of claim 10, wherein the at least one of the plurality of airfoils is one of a rotor blade and a stator vane.

12. The engine of claim 10, wherein the pedestal is one of a cylinder and an elliptic cylinder.

13. The engine of claim 10, wherein the profile at a second point includes a second local maximum value of the radius of curvature, the second point being a point around the periphery nearest the trailing edge.

14. The engine of claim 10, wherein the profile is a compound curve described at any point by a first radius of curvature describing a first portion of the profile at that point and a second radius of curvature describing a second portion of the profile at that point, each radius having a different center point; the first portion being closer to the corresponding one of the pressure side wall and the suction side wall than the second portion; the profile at a first point includes a first local maximum value of the first radius of curvature; the first point being a point around the periphery nearest the leading edge.

15. The engine of claim 10, wherein the profile is a simple curve described at any point by a radius of curvature at that point; the profile at a first point includes a first local maximum value of the radius of curvature; the first point between a second point around the periphery nearest the leading edge, and a third point around the periphery nearest the trailing edge.

16. The engine of claim 15, wherein the first point is closer to the second point than to the third point.

17. The engine of claim 16, further comprising:

a platform from which the leading edge, trailing edge, pressure side wall, and suction side wall extend;

wherein the first point is closer to the platform than either of the second point or the third point.

18. The engine of claim 16, further comprising:

a platform from which the leading edge, trailing edge, pressure side wall, and suction side wall extend;

wherein the first point is farther from the platform than either of the second point or the third point.

19. A method for providing enhanced gas turbine engine airfoil durability, the method comprising:

introducing cooling air into an internal cooling channel within the airfoil;

flowing the cooling air through the internal cooling channel past pedestals connected to walls of the airfoil; the internal cooling channel including fillets at pedestal ends, at least some of the fillets including a profile that is non-uniform around the periphery of the corresponding pedestal end, wherein the profile is a simple curve described at any point around the periphery of the corresponding pedestal end by a radius of curvature at a point; the profile at a first point includes a first local maximum value of the radius of curvature; the first point being a point around the periphery nearest a leading edge of the airfoil; and exhausting cooling air through trailing edge cooling slots.

* * * * *